United States Patent [19]

Jacob

[11] Patent Number: 5,069,412

[45] Date of Patent: Dec. 3, 1991

[54] PICTURE HANGER

[75] Inventor: Richard J. Jacob, Montgomery County, Ohio

[73] Assignee: 333 Products, Inc., Kettering, Ohio

[21] Appl. No.: 698,278

[22] Filed: May 10, 1991

[51] Int. Cl.[5] ..... A47G 1/16

[52] U.S. Cl. ..... 248/493; 248/301; 248/497; 248/547

[58] Field of Search ..... 248/489, 493, 495, 497, 248/475.1, 547, 300, 301, 317; D8/367, 371, 373

[56] References Cited

U.S. PATENT DOCUMENTS

| | | | |
|---|---|---|---|
| D. 299,003 | 12/1988 | Fadely, Jr. | D8/367 |
| 2,330,373 | 9/1943 | Moore | 248/489 |
| 2,454,813 | 11/1948 | Larson | 248/32 |
| 2,464,295 | 3/1949 | Edgar | 248/489 |
| 3,226,065 | 12/1965 | Smith | 248/32 |
| 3,294,356 | 12/1966 | Sherman | 248/476 |
| 3,912,211 | 10/1975 | Topf | 248/489 |
| 3,982,719 | 9/1976 | Kilborne | 248/489 |
| 4,026,510 | 5/1977 | Holmes | 248/493 |
| 4,804,161 | 2/1989 | Wallo | 248/489 X |
| 4,858,871 | 8/1989 | Romono | 248/489 X |

*Primary Examiner*—Ramon O. Ramirez
*Attorney, Agent, or Firm*—Reuben Wolk

[57] ABSTRACT

A picture hanger formed of a thin flat sheet of material of uniform thickness having integral means for supporting the wire which is secured to the picture. The sheet has support means spaced from each other formed of portions bent out an an angle from the planar surface of the sheet, these portions serving as wire support means and permitting adjustable positioning of the picture. The sheet also has outwardly bent portions with holes for mounting the hanger to a wall, as well as holes in the flat portion through which nails may be driven into the wall to mount the hanger, or other types of fasteners may be used to install the hanger.

13 Claims, 1 Drawing Sheet

PICTURE HANGER

BACKGROUND OF THE INVENTION

1. Field of the invention

This invention relates to picture hangers of the type which are mounted on a wall, and has members which support the picture by means of wire secured to the picture which is passed over the members to provide the support.

2. Prior art statement

The conventional picture hanger which is in widespread use, consists simply of a metal piece which has a single hook-shaped lower portion for holding the picture wire, and a single upper portion with a hole therethrough into which a nail is driven into the wall. It has been known to form the single hanger support of a metal blank having a bent out tongue to support the wire, and a bumped out V-shaped portion completely across the blank in which a nail hole is placed, as shown in U.S. Pat. No. 2,454,813 issued to Larson. It has also been proposed that a single hanger may have multiple picture wire support means, as shown in U.S. Pat. No. Des. 299,033 issued to Fadely, Jr. and U.S. Pat. No. 3,982,719 issued to Kilborne. It has been further proposed to provide multiple support means on a wider body member having multiple nail holes by Smith, U.S. Pat. No. 3,226,065 and by Sherman, U.S. Pat. No. 3,294,356. However, by the nature of their construction, these multiple support hangers do not provide the strength, rigidity, or versatility necessary for proper support of the wire or for attachement to the wall.

SUMMARY OF THE INVENTION

The present invention relates to an improved picture hanger which provides a sturdy support for the picture, and greatly simplifies the procedure whereby the picture may be kept level after it is hung. The hanger may be made inexpensively to compete in the marketplace with existing products, and offers exceptional strength, rigidity and versatility in the manner in which it may be mounted on a wall. It also provides simplified positioning of the picture and maintains its level position which is highly desirable in displaying pictures. It should be noted that although the use of the novel hanger is referred to with respect to pictures throughout this application, the hanger may similarly be used for hanging and positioning mirrors and other types of art work as well.

The novel hanger is formed of a thin flat sheet of material, such as aluminum or other metals, having a uniform thickness. Picture support means are formed in the sheet in an integral manner by bending portions of the sheet outwardly from the planar surface of the sheet at an acute angle, and nail holding members are also integrally formed from the sheet by bending other portions of the sheet in the same direction. Holes are formed in the upper portion of the nail holding members through which nails may be driven to mount the hanger on the wall. Additional holes are provided in the flat portion of the sheet for use as alternative attaching means.

It is therefore a principal object of the invention to provide a picture hanger with superior wire supporting properties, capable of supporting pictures ranging from light weight to very heavy weight.

It is another object to provide the hanger with a plurality of wire supporting means to ensure a level positioning of the picture.

It is further object to utilize the hanger to maintain the picture in the level position.

It is another object to provide alternative means for attaching the hanger to the wall.

Other objects, uses and advantages of the invention are apparent from the following description and drawings.

DESCRIPTION OF THE PREFERRED EMBODIMENTS

Figure 1:
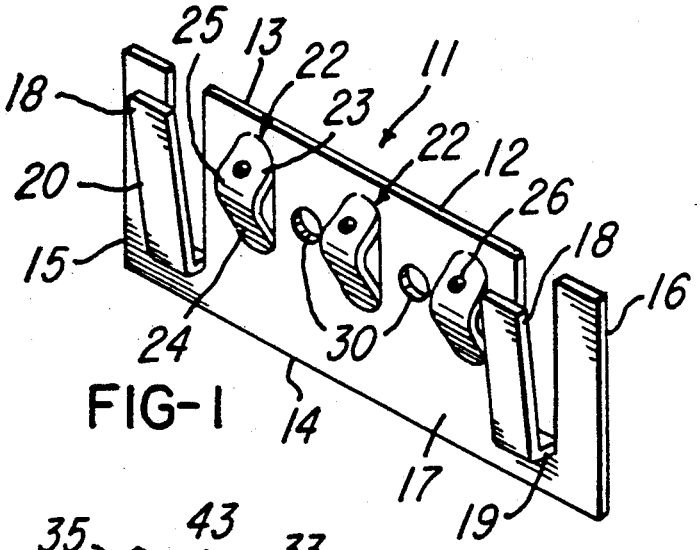
FIG. 1 is a perspective view of the novel picture hanger.

Referring now to the drawings, the novel picture hanger 11 is best shown in FIG. 1 and consists of a thin flat metal sheet 12 of uniform thickness, preferably made of aluminum approximately one-sixteenth inch thick. The sheet has an upper edge 13, a lower edge 14, side edges 15 and 16, and a planar surface 17. Two portions 18, which serve as wire support means, are bent outwardly from the sheet and are formed from portions of the upper edge, spaced inwardly from the side edges and upwardly from the lower edge, each portion being formed with a first flat section 19 which extends for a short distance form the planar surface 17 of the sheet at an angle of approximately 90 degrees thereto, then a longer section 20 integral with section 19 and extending at an acute angle of about 20 degrees to the planar surface. The portions thus remain integral with the sheet, and are spaced apart from each other for nearly the entire length of the hanger, thus providing excellent stabilizing properties. The junction formed by the flat section 19 and angle section 20 provides the actual support for the picture wire 21 (FIG. 2) which is secured to the picture (not shown). The flat section is spaced so that there is less chance of pinching, cutting or abrading the wire than if the section were angled directly from the sheet.

Figure 2:
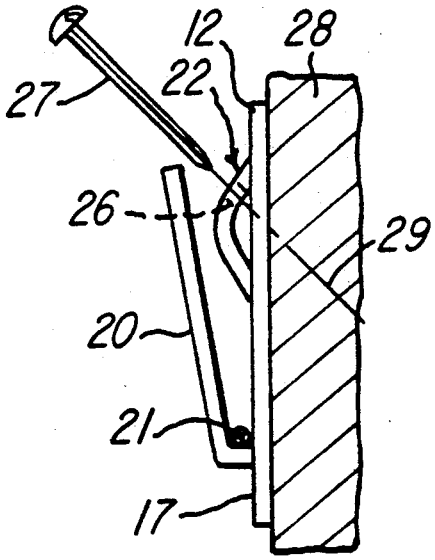
FIG. 2 is a side view of the hanger.

In order to provide nail fastening holes, the sheet 12 also has outwardly extending members 22 which are formed from the upper area of the sheet by stamping these members so that each forms upper and lower transverse portions 23 and 24 having generally triangular side surfaces meeting at an apex 25. The bases of the portions are on the planar surface 17 and are integral therewith, and the apex extends outwardly from the planar surface in the same direction as the support portions 18. The portions 23 and 24 have an included angle of about 90 degrees, which means that each section extends from the planar surface at an angle of about 45 degrees. The upper portions 23 each have nail holes 26, approximately 0.09 inches in diameter which are adapted to permit mounting nails 27 to be driven through the holes into the wall 28 along the line designated by reference numeral 29, as shown in FIG. 2. In the case of light weight pictures, mounting will easily be made by using one or more finishing nails.

It is also possible to affix the hanger to the wall by an alternative method, such as by using the holes 30 located in the sheet between members 22, but which could be located elsewhere in the flat portion. These holes are slightly larger than nail holes 26, and are used to mount heavy pictures by using nails, screws, lag bolts, or the like.

Figure 3:
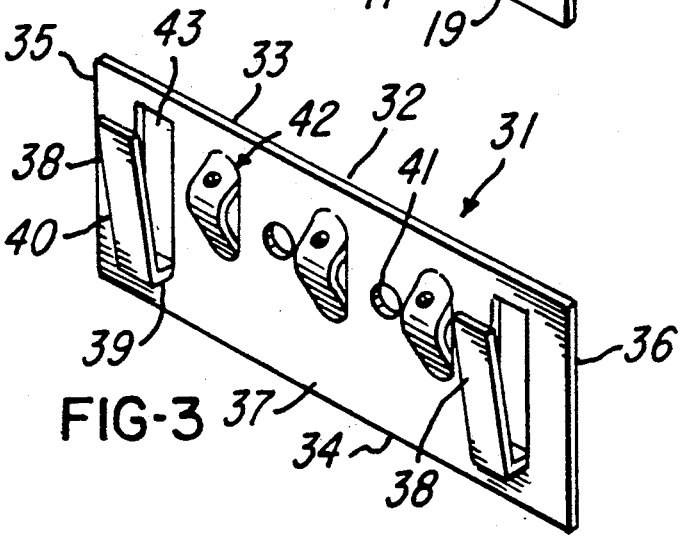
FIG. 3 is a view similar to FIG. 1, illustrating a modified form of the invention.

FIG. 3 illustrates a modified form of the invention, wherein a hanger 31 is formed of a sheet 32 similar to sheet 12. The sheet has an upper edge 33, a lower edge 34, side edges 35 and 36, and a planar surface 37. In this modification, the wire supporting portions 38 do not extend to the top edge, which remains continuous, but are spaced from the top edge and when formed leave openings 43 in the sheet. The portions 38 are formed similarly to portions 18, each having a flat section 39 and an angled section 40. The hanger has a plurality of nail holding members 42, similar to the members 22, and larger holes 41 similar to holes 30.

Figure 4:
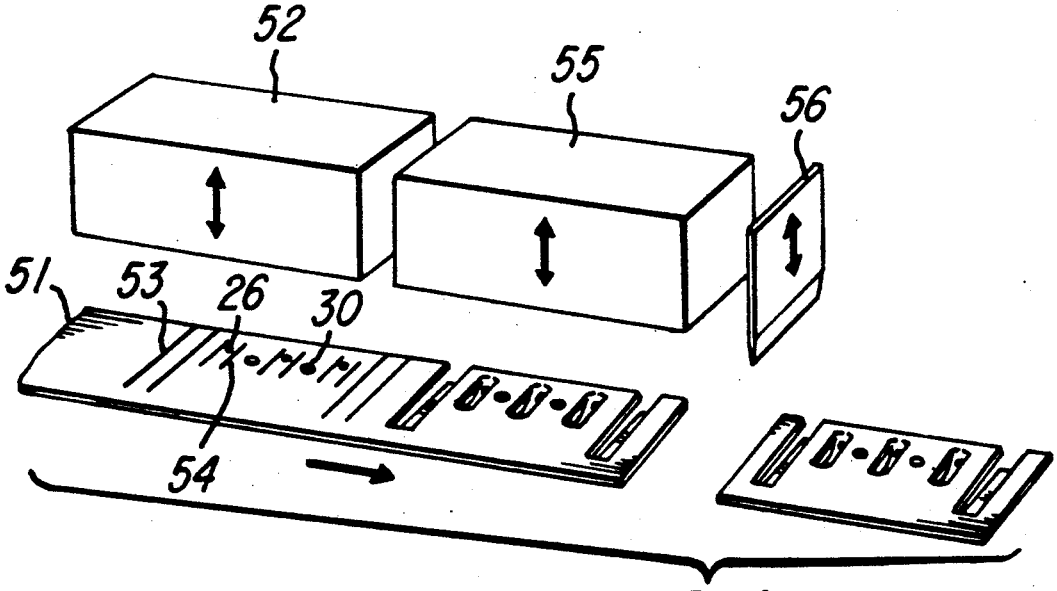
FIG. 4 is a schematic view of a preferred method of manufacturing the hanger of FIG. 1.

FIG. 4 illustrates in diagrammatic fashion a preferred method of manufacturing the hanger of FIGS. 1 and 2. A continuous flat strip of desired material 51, typically 16 gauge aluminum about one inch wide, is fed in a conveyor system into position under a first punch press 52, which punches the strip to form cut segments 53 and 54, and simultaneously forms holes 26 and 30. The strip then moves into a new position under a forming press 55 which forms the portions 18 and 20 from the cut segments. Finally, the strip is cut into final sheet 12, which becomes the finished product 11, by means of a cutter 56. The operation shown in FIG. 4 is in a downward direction, meaning that the planar surface 17 is also downward and the formation of the portions 18 and 20 is in a reverse direction than shown in FIG. 1.

The versatility of the novel hanger may be better understood by presenting the various options provided by the design. First of all, it is not even necessary to mount the hanger in a level position to place the supported picture in a level position. This is because of the separate spaced supporting means. The user may select any of the following methods of attaching the picture to the wall:

1. Drive one nail into the hole 26 in the center one of the nail holding members, in the event the picture is light and the wall is made of a material such as wood. The hanger will not swing.

2. Drive the nails into two holes in the outer nail holding members 22, thus providing a positive installation.

3. Use one or more of the large nail holes 30 for driving a "molly" bolt or expanding anchor nut into dry wall or plaster where no stud is present. This is useful for heavy pictures where the smaller holes may be insufficient.

4. Any combination of holes 26 and 30.

The preferred embodiments of the invention have been described above, but it should be understood that various other embodiments may be presented within the the spirit of the invention, and are also encompassed within the claims set forth herein. For example, although three nail holding members are shown, 2, 4, or more may be used depending on the load to be carried. Also, more than the two larger holes 30 may be utilized. It should also be understood that although the preferred material for making the hanger is aluminum, other metals may be used; and the product may also be molded from a rigid plastic material such as ABS or nylon.

I claim:

1. In a picture hanger having integral picture wire support means; the improvement wherein said hanger is formed of a thin flat rectangular sheet of uniform thickness having a substantially uninterrupted planar surface having upper, lower and side edges, said support means being formed from bent out portions of said sheet, said support means formed from segments of said sheet including portions of said upper edge, and extending along a major extent of said sheet in a direction toward said lower edge, said bent out portions extending outwardly at an angle to said planar surface and having spaced wire contact points, whereby said support means provide adjustable positioning of said picture.

2. The hanger of claim 1 wherein said support means are spaced upwardly of said lower edge.

3. The hanger of claim 1 wherein said support means are formed from segments of said sheet, said upper edge being continuous along its full length between said side edges.

4. The hanger of claim 1 wherein said support means have a first section extending outwardly at approximately right angles to the planar surface of said sheet, and a second section integral with and extending outwardly from said first section at an acute angle relative to said planar surface, whereby said first and second sections provide said wire contact points.

5. The hanger of claim 4 wherein said acute angle is approximately 30 degrees.

6. The hanger of claim 1 wherein said support means comprise a minor segment of said sheet.

7. In a picture hanger having integral picture wire support means; the improvement wherein said hanger is formed of a thin flat rectangular sheet of uniform thickness having a substantially uninterrupted planar surface having upper, lower and side edges, said support means being formed from bent out portions of said sheet extending outwardly at an angle to said planar surface and having spaced wire contact points, said hanger further comprising means for mounting said hanger to a vertical surface, said means comprising integral spaced nail holding members formed from outwardly extending portions of said sheet, said nail holding members being spaced below said upper edge, whereby said support means provide adjustable positioning of said picture.

8. The hanger of claim 7 wherein said nail holding members comprise a minor segment of said sheet.

9. The hanger of claim 8 wherein each of said nail holding members has upper and lower portions forming triangular side surfaces meeting at an apex, the bases of said side surfaces being on said planar surface and said apex extending outwardly therefrom on the same side of said sheet as said support means.

10. The hanger of claim 9 wherein said side surfaces of said triangular member have an included angle of approximately 90 degrees.

11. The hanger of claim 7 wherein said nail holding members are located approximately midway between said side edges.

12. The hanger of claim 7 comprising nail holes in said nail holding members.

13. The hanger of claim 7 comprising additional nail holes in the planar portion of said sheet.

* * * * *